US012668973B1

(12) United States Patent
Fails

(10) Patent No.: US 12,668,973 B1
(45) Date of Patent: Jun. 30, 2026

(54) ROOFING MATERIAL REMOVAL APPARATUS

(71) Applicant: Joshua Fails, Monroeville, AL (US)

(72) Inventor: Joshua Fails, Monroeville, AL (US)

( * ) Notice: Subject to any disclaimer, the term of this patent is extended or adjusted under 35 U.S.C. 154(b) by 389 days.

(21) Appl. No.: 18/229,634

(22) Filed: Aug. 2, 2023

Related U.S. Application Data

(60) Provisional application No. 63/394,781, filed on Aug. 3, 2022.

(51) Int. Cl.
*E04D 15/00* (2006.01)
*E04D 15/02* (2006.01)

(52) U.S. Cl.
CPC ..... *E04D 15/003* (2013.01); *E04D 15/02* (2013.01)

(58) Field of Classification Search
CPC ..... E04D 15/02; E04D 15/003
USPC ..... 81/45
See application file for complete search history.

(56) References Cited

U.S. PATENT DOCUMENTS 6,116,117 A 9/2000 Nicolosi et al.
7,156,383 B1 * 1/2007 Jacobs ..... E04F 21/22 254/11
7,313,985 B2 1/2008 Willis
7,802,854 B1 9/2010 Lane et al.
8,056,444 B1 * 11/2011 Van Straten ..... E04D 15/003 299/37.1
8,079,290 B2 12/2011 Cox
8,176,815 B2 5/2012 Sparks
9,623,548 B1 4/2017 Johnson
9,945,128 B1 4/2018 Baird
10,648,179 B2 5/2020 Baird
10,968,088 B2 * 4/2021 Dorsey ..... E04G 3/28
2019/0032338 A1 * 1/2019 Baird ..... E04D 15/02

* cited by examiner

*Primary Examiner* — Katina N. Henson
(74) *Attorney, Agent, or Firm* — Cramer Patent & Design, PLLC.; Aaron R. Cramer

(57) ABSTRACT

A roofing material removal apparatus is an apparatus to aid in the removal of existing roof shingles and tar paper. The device utilizes a removal frame, made of aluminum pipe, that is positioned on one side of a roof that is to be torn off. The removal frame is adjustable in overall length to fit the size of the roof. It is envisioned that extremely wide sections of roofs would be done in two or more passes. A section of strong aircraft cable is connected to the center of the removal frame and routed through a pulley that is fastened to the opposite side of the roof. The pulley prevents roof damage by keeping the cable from cutting into the roof. This cable is then connected to a vehicle mounted winch at grade level. During operation, the removal frame starts at the far end of the roof, removing all shingles, tar paper and similar roofing materials. As the removal frame is pulled forward by the cable and the winch, it pushes all of the loose material in much the same manner as a plow. Upon reaching the far side of the roof, the material simply falls into a properly placed dumpster.

16 Claims, 8 Drawing Sheets

ROOFING MATERIAL REMOVAL APPARATUS

RELATED APPLICATIONS

The present invention was first described in and is a continuation of U.S. Provisional Application No. 63/394,781, filed Aug. 3, 2022, the entire disclosures of which are incorporated herein by reference.

FIELD OF THE DEVICE

The present invention relates to an apparatus and method for automated demolition and removal of roofing material from a structure.

BACKGROUND OF THE DEVICE

Anyone who has worked in the roofing industry will attest to the fact that it is a physically demanding line of work. Carrying heavy goods, enduring high heat and blazing sun, climbing steep roofs, and working at dangerous elevations above ground are all part of a typical day for someone who works in construction. Anything that speeds up work or makes it easier to do a good job is very much appreciated. The removal of the old roof, which is more generally referred to as a "tear-off," is a requirement for many of these roofing projects as well. It requires a significantly higher level of physical energy to loosen, rip up, and then push off the old shingles, which then need to be removed off the roof. It is possible that the user will become more prone to making errors if they continue to apply a significant amount of physical power.

These kinds of blunders can not only lead to injuries caused by physical strain, but they can also cause a person to lose their footing on the roof and die. As a consequence of this, there is a want for a technique that makes it possible to effortlessly remove outdated roofing shingles and components without the application of a significant amount of manual labor. This requirement has been satisfied with the invention of the roofing material removal apparatus.

SUMMARY OF THE DEVICE

The roofing material removal apparatus is a device designed to facilitate the removal of roofing materials, such as shingles and tar paper, from the roof surface of a structure and onto the ground or into a container. The apparatus consists of a lower frame and an upper frame connected at two pivot points. The upper frame can pivot between an open insertion space and a closed position. The lower frame has a pulling eye located at its central point, which is used in conjunction with a high-strength cable, a pulley, and a capstan winch to move the apparatus along the roofed surface.

The frames are constructed using individual structural elements made of steel tubing or steel angle. The lower frame is generally rectangular, with a lower front portion, lower side portions, and a lower rear portion. On the other hand, the upper frame is generally three-sided, with upper side portions and an upper rear portion. A pair of lugs extend upward from the front corners of the lower frame, providing a pivoting attachment for the distal front ends of the upper side portions. The apparatus includes a set of sleeves on the frames, allowing for width adjustment along an adjustable width travel path. These sleeves are secured with fasteners.

Both the lower and upper frames have gripping teeth on their upper surfaces to aid in material removal. The upper frame pivots about the pivot points to create the open insertion space, making it easier to position the apparatus over the roofing materials. When in the closed position, multiple threaded tabs on the frames align and are held together using second fasteners. This ensures a secure closure and minimizes the gap between the frames.

The apparatus is adjustable in length by manipulating the set of sleeves and first fasteners, enabling its use on various sizes of roofing surfaces. In a preferred usage scenario, the upper frame is approximately eight inches wide and six feet long. For larger roofed surface areas, multiple passes of the apparatus can be used to remove the roofing material effectively.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
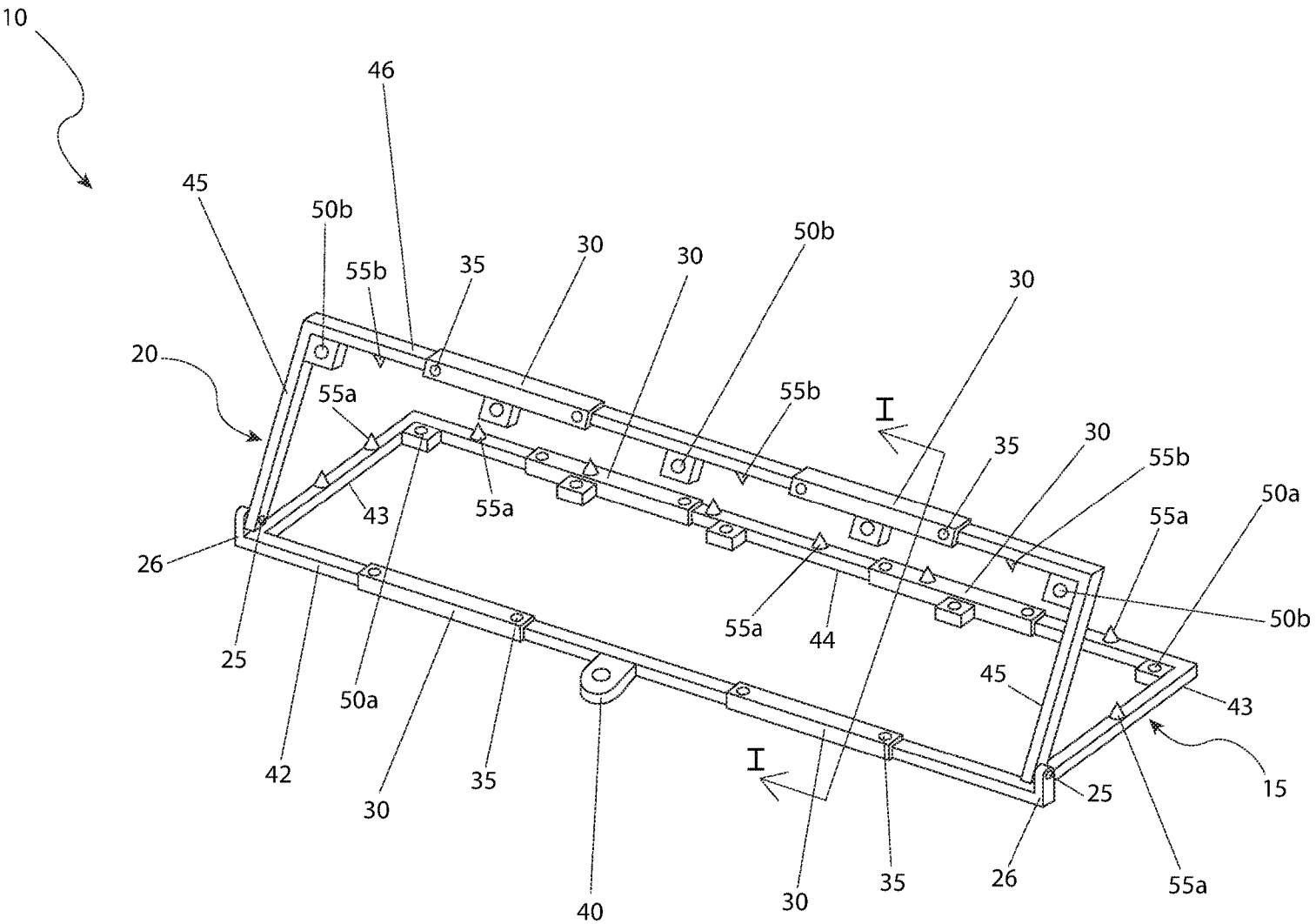
FIG. 1 is an isometric view of the roofing material removal apparatus 10, in an open position, according to the preferred embodiment of the present invention.

10 roofing material removal apparatus
15 lower frame
20 upper frame
25 pivot point
26 lug
30 sleeve
35 first fastener
40 pulling eye
42 lower frame front portion
43 lower frame side portion
44 lower frame rear portion
45 upper frame side portion

46 upper frame rear portion
50*a* upper tab
50*b* lower tab
55*a* upper gripping teeth
55*b* lower gripping teeth
60 second fastener
65 fastener insertion travel path "a"
70 open insertion space
72 gap
75 roofing material
80 structure
85 roofed surface
90 insertion travel path "b"
95 adjustable width travel path "c"
100 high strength cable
105 pulley
110 capstan winch
115 cable leading edge
120 immovable object
121 ground surface
125 apparatus travel path "d"
130 container
135 falling material travel path "e"

1. DESCRIPTION OF THE INVENTION

The best mode for carrying out the invention is presented in terms of its preferred embodiment, herein depicted within FIGS. 1 through 9. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

All of the implementations described below are exemplary implementations provided to enable persons skilled in the art to make or use the embodiments of the disclosure and are not intended to limit the scope of the disclosure, which is defined by the claims.

2. DETAILED DESCRIPTION OF THE FIGURES

Referring now to FIGS. 1 and 5-7, various views of the roofing material removal apparatus 10, in an open state, according to the preferred embodiment of the present invention is disclosed. The roofing material removal apparatus (herein also described as the "apparatus") 10, aids in the removal of roofing material 75, such as existing roof shingles and tar paper, from a roofed surface 85 of a structure 80 and onto a ground surface 121 or a container 130. The roofing material removal apparatus 10 includes a lower frame 15 and an upper frame 20 joined together at a pir of pivot points 25. It is envisioned that the roofing material removal apparatus 10 is approximately eight inches (8 in.) wide and six feet (6 ft.) long in a preferred usage scenario. The exact length of the roofing material removal apparatus 10 is not intended to be a limiting factor of the present invention. The overall length of the roofing material removal apparatus 10 is adjustable by a set of sleeves 30 (see FIG. 8) that each lock in place with the use of at least one (1) first fastener 35. In such a manner the roofing material removal apparatus 10 may be used on sections of a roofed surface 85 that are smaller and larger than the preferred overall length. Extremely larger roofed surface 85 areas would be completed using multiple passes of the roofing material removal apparatus 10. A pulling eye 40 is positioned at a central point of the lower frame 15 as shown. Further description on the usage of the pulling eye 40 will be described in greater detail herein below.

Both the lower frame 15 and the upper frame 20 are constructed of individual structural elements such as steel tubing, steel angle, or the like. The exact configuration or material of construction is not intended to be a limiting factor of the present invention. In the exemplary embodiment, the lower frame 15 comprises a generally rectangular steel frame, having a lower front portion 42, a pair of lower side portions 43, and a lower rear portion 44. The upper frame 20 comprises a generally three-sided steel frame, having a pair of upper side portions 45, and an upper rear portion 46. A pair of lugs 26 extend upward from opposing front corners (i.e., where the lower side portions 43 meet the lower front portion 42) of the lower frame 15. Each lug 26 permits a pivot point 25 to provide a pivoting attachment for the distal front ends of the pair of upper side portions 45 to the lugs 26. The pivot points 25 enable the upper frame 20 to travel in a pivoting direction between an open insertion space 70 (see FIG. 3) and a closed position (see FIG. 4). The closed position still provides a minimal gap 72 between the upper frame 20 and lower frame 15. The pulling eye 40 is located on the front portion of the lower frame 15 and extends forwardly therefrom.

The lower front portion 42, lower rear portion 44, and upper rear portion 46 each comprise at least one (1) sleeve 30 to provide any desired width adjustment along the adjustable width travel path "c" 95 (see FIG. 9), capable of being secured with the first fasteners 35. The sleeves 30 should not interfere with the tabs 50*a*, 50*b*, or pivot points 25. The lower frame 15 comprises multiple threaded lower tabs 50*a* spaced along the lower rear portion. The upper frame 20 comprises multiple threaded upper tabs 50*b* also spaced along the upper rear portion that coalign with the lower tabs 50*a* when the upper frame 20 is pivoted fully downward relative to the lower frame 15. A plurality of lower gripping teeth 55*a*, preferably equidistantly spaced, extend outward from an upper surface of the lower rear portion 44, any sleeve 30, and the lower side portions 43. Further detail on the tabs 50*a*, 50*b* and the gripping teeth 55*a*, 55*b* will be provided herein below.

Figure 2:
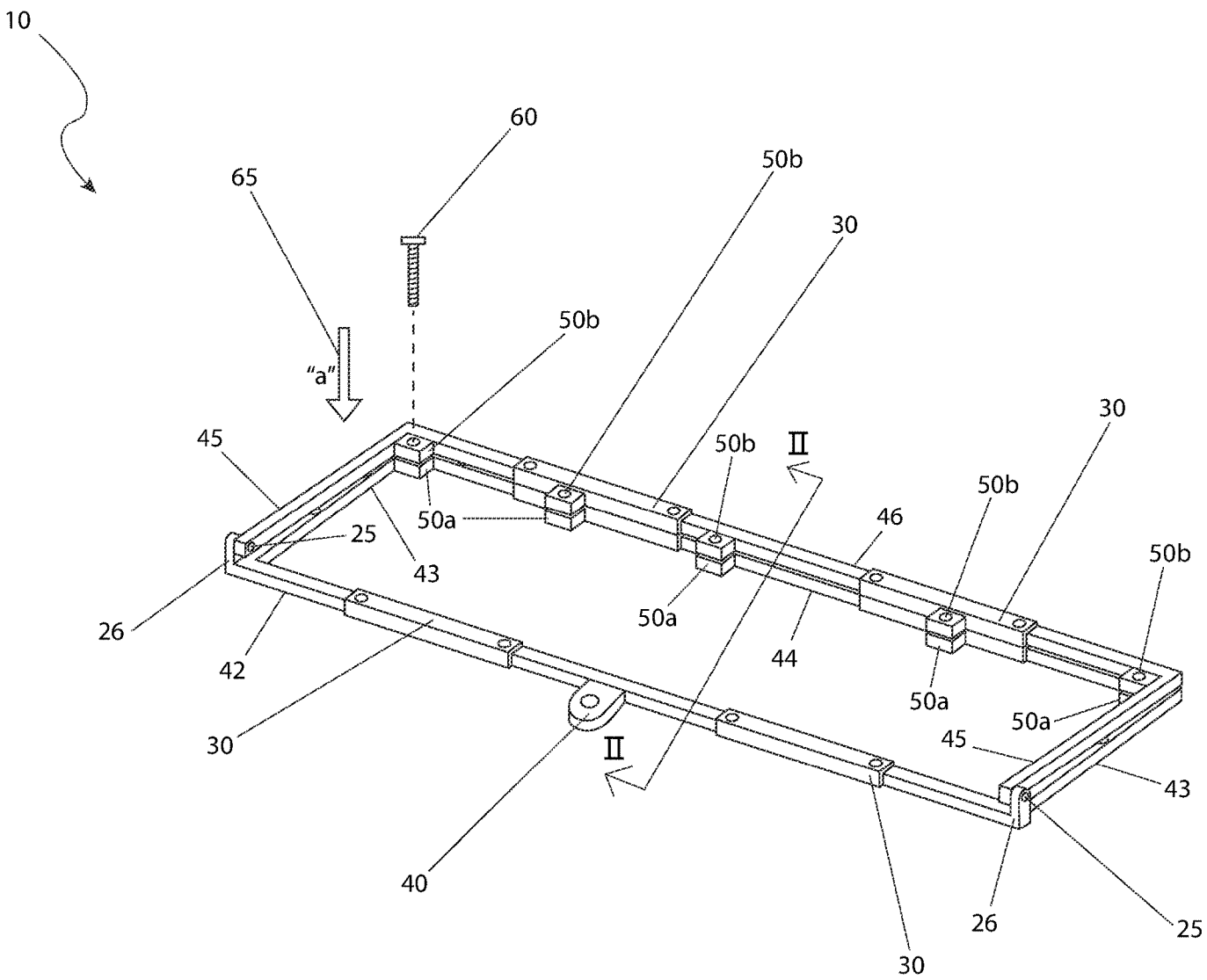
FIG. 2 is an isometric view of the roofing material removal apparatus 10, in a closed position, according to the preferred embodiment of the present invention.

Referring next to FIG. 2, an isometric view of the roofing material removal apparatus 10, in a closed state, according to the preferred embodiment of the present invention is depicted. This view discloses the lower frame 15 and the upper frame 20 (both of which are as shown in FIG. 1), in a closed position and in physical contact with each other about the pivot points 25. The tabs 50*a*, 50*b* are also abutting each other and aligned. A plurality of second fasteners 60, such as a threaded bolt, are each configured to be inserted along a fastener insertion travel path "a" 65 and is used to hold an individual aligned pair of tabs 50*a*, 50*b* in physical contact and would be inserted using conventional hand tools or battery-powered driver tools. The sleeves 30 still allow for width adjustment, and the pulling eye 40 remains accessible when the roofing material removal apparatus 10 is in a closed position as shown.

Figure 3:
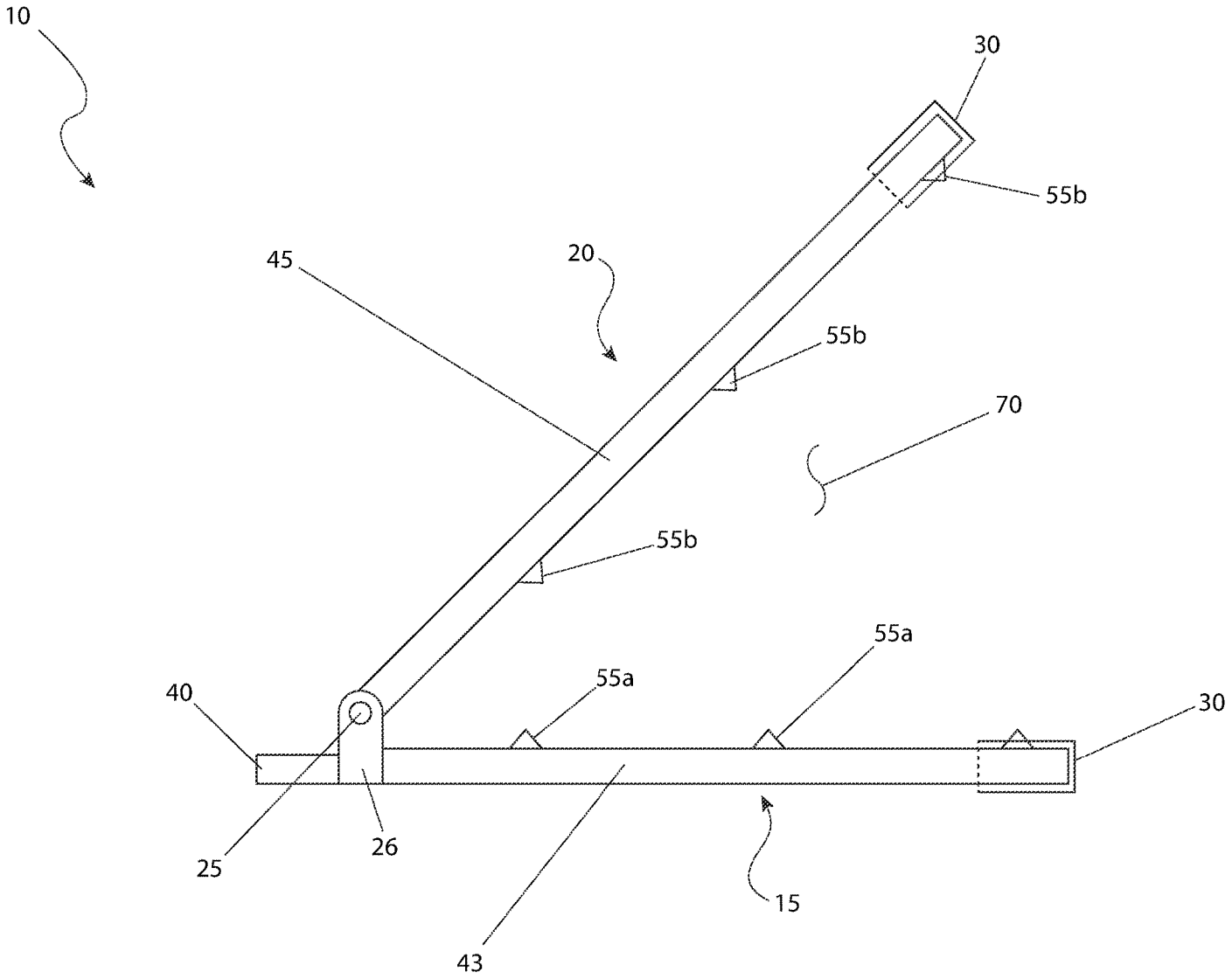
FIG. 3 is a sectional view of the roofing material removal apparatus 10, as seen along a line I-I, as shown in FIG. 1, according to the preferred embodiment of the present invention.

Referring now to FIG. 3, a sectional view of the roofing material removal apparatus 10, as seen along a line I-I, as shown in FIG. 1, according to the preferred embodiment of the present invention is shown. In its open position as shown, the lower frame 15 and the upper frame 20 form an open insertion space 70 into which roofing material 75 to be removed may be place as will be shown in greater detail herein below. The gripping teeth 55*a*, 55*b* may impinge upon the roofing material 75 thereby aiding in retention within the roofing material removal apparatus 10. The upper frame 20 pivots about the pivot points 25 to produce the open insertion space 70. The sleeves 30 and the pulling eye 40 remain visible.

Figure 4:
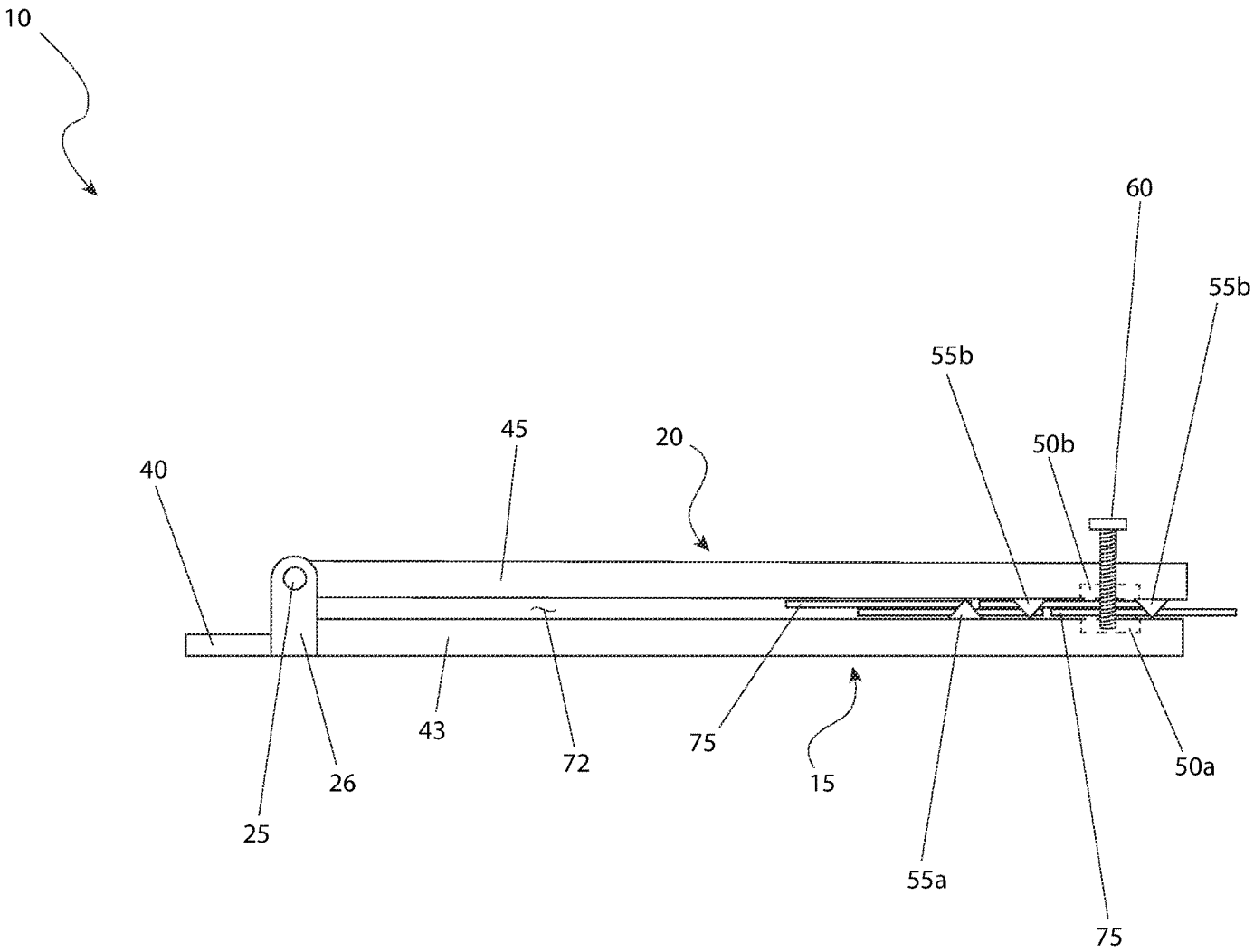
FIG. 4 is a sectional view of the roofing material removal apparatus 10, as seen along a line II-II, as shown in FIG. 1, according to the preferred embodiment of the present invention.
Figure 5:
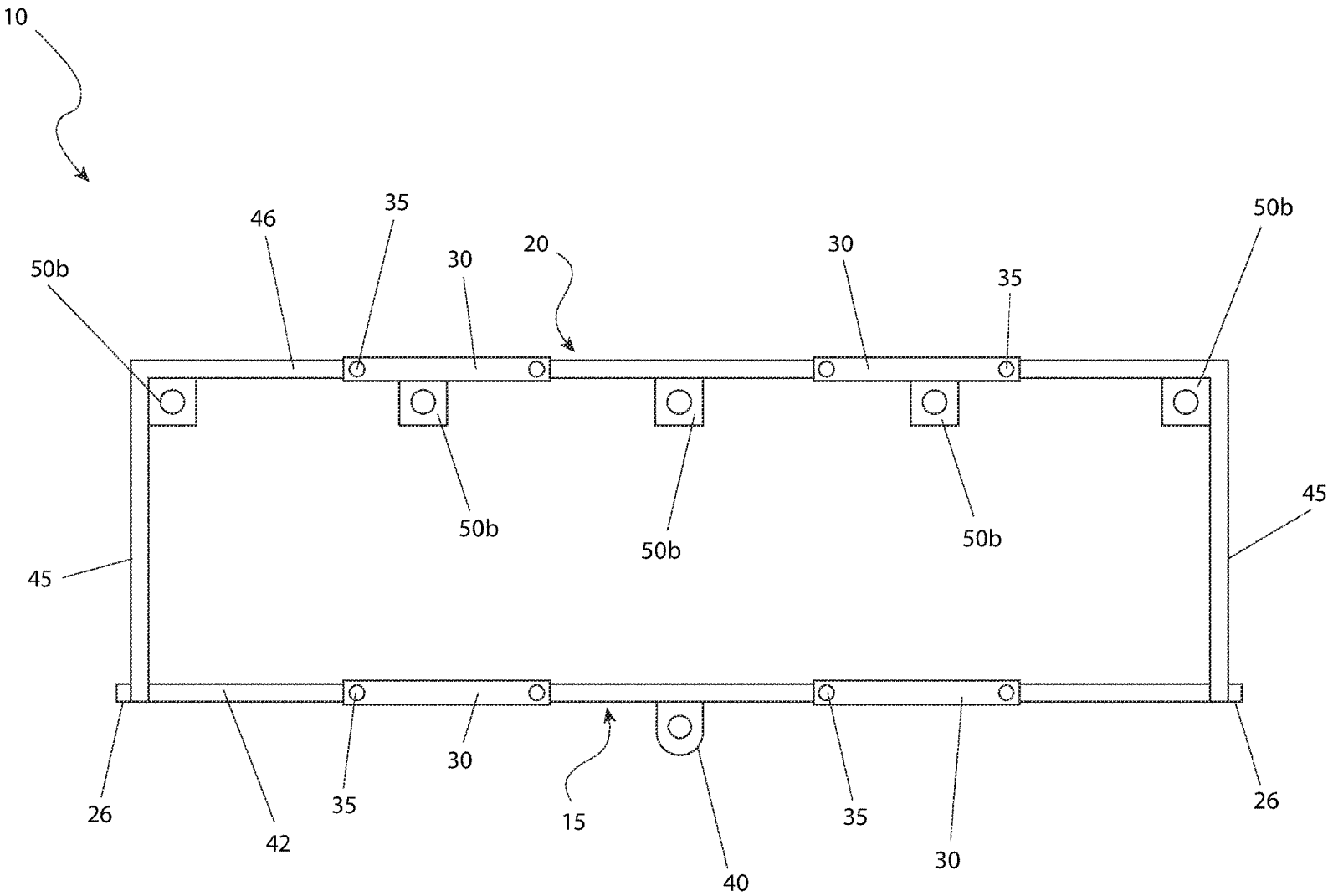
FIG. 5 is a top plan view of the roofing material removal apparatus 10, in an open position, according to the preferred embodiment of the present invention.
Figure 6:
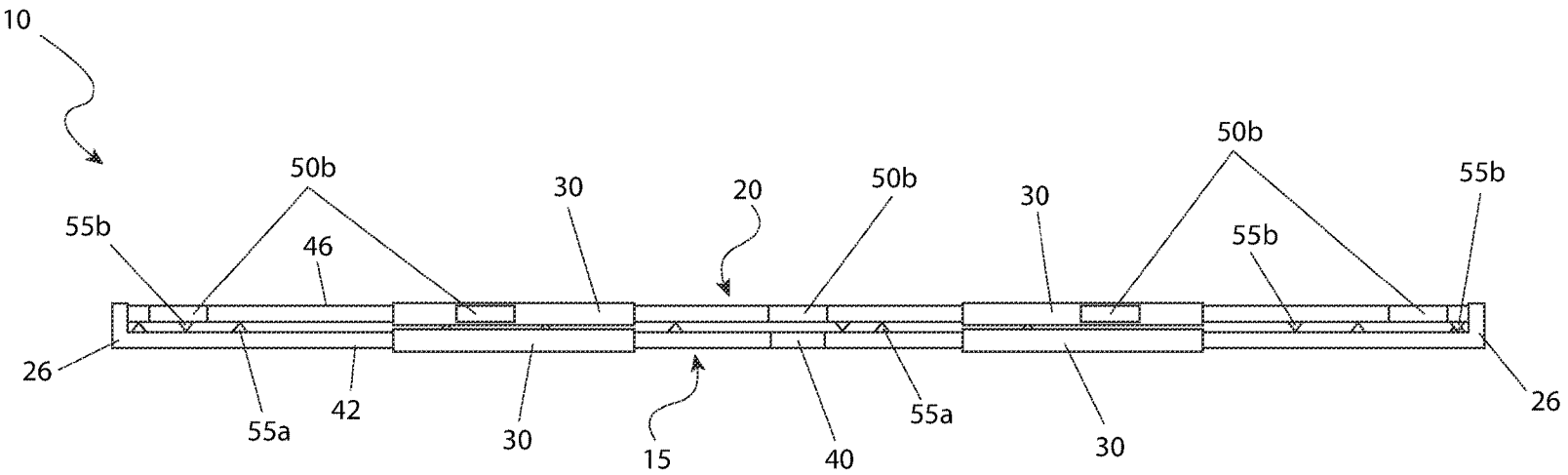
FIG. 6 is a front elevation view of the roofing material removal apparatus 10, in an open position, according to the preferred embodiment of the present invention.
Figure 7:
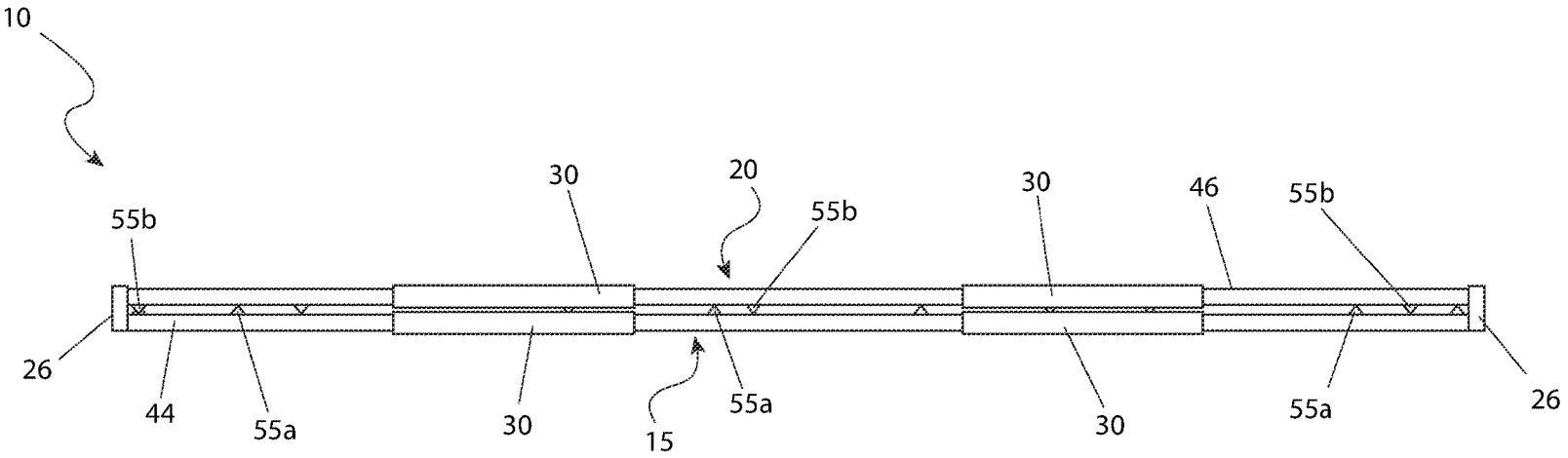
FIG. 7 is a rear elevation view of the roofing material removal apparatus 10, in an open position, according to the preferred embodiment of the present invention.
Figure 8:
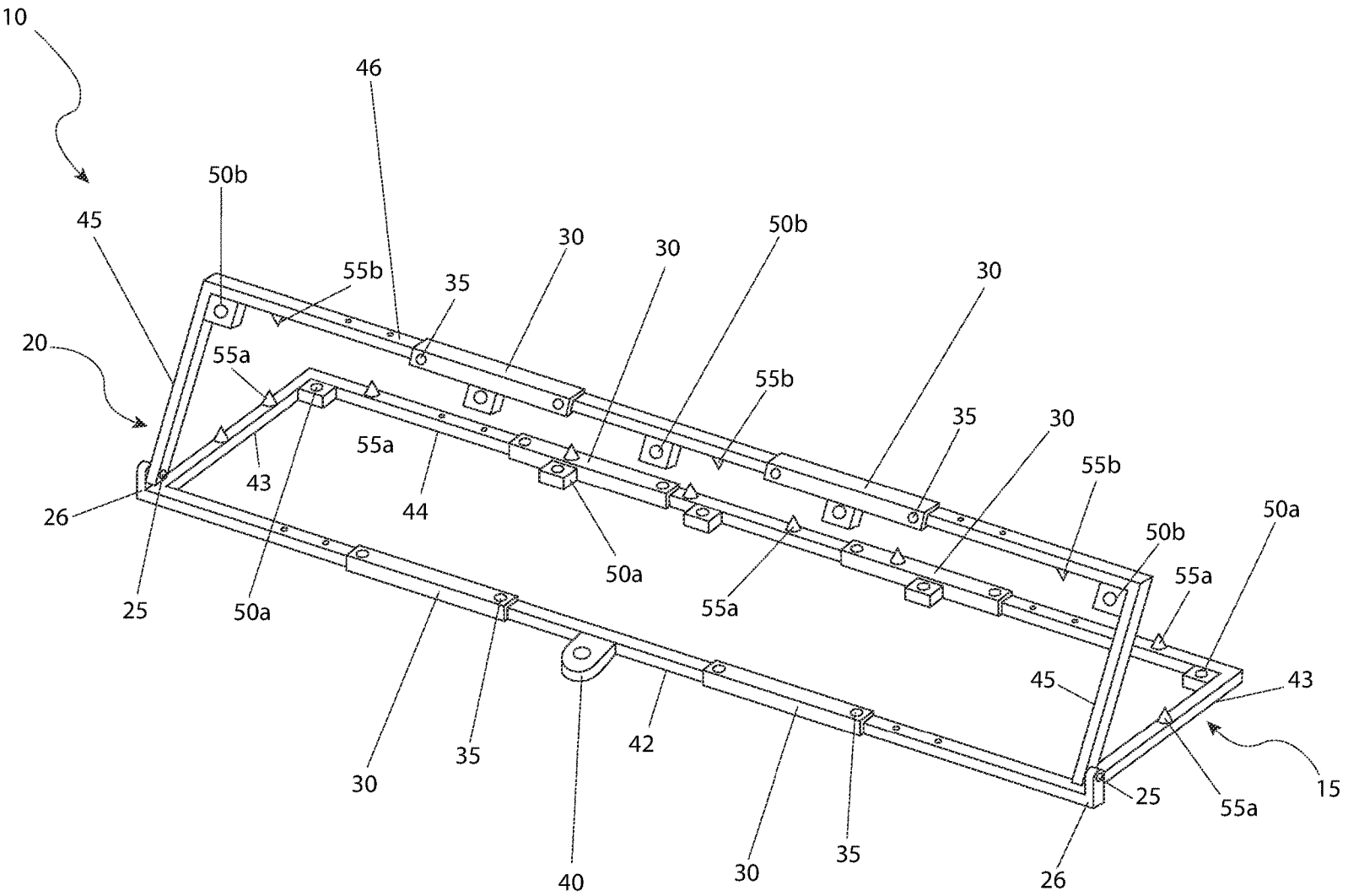
FIG. 8 is an isometric view of the roofing material removal apparatus 10, in an extended state, according to the preferred embodiment of the present invention; and, FIG. 9 is a perspective view of the roofing material removal apparatus 10, shown in a utilized state, according to the preferred embodiment of the present invention.

Referring next to FIG. 4, a sectional view of the roofing material removal apparatus 10, as seen along a line II-II, as shown in FIG. 1, according to the preferred embodiment of the present invention is disclosed. In this view, the lower gripping teeth 55*a* of the lower frame 15 and gripping teeth 55*b* of the upper frame 20 impinge upon roofing material 75. Further holding force is added by the use of multiple second fasteners 60 that are inserted into coaligned pairs of tabs 50*a*, 50*b* and secured to a suitable torque specification. The second fasteners 60 working with the pivot points 25 form a captive structure, suitable for movement via the pulling eye 40.

Figure 9:
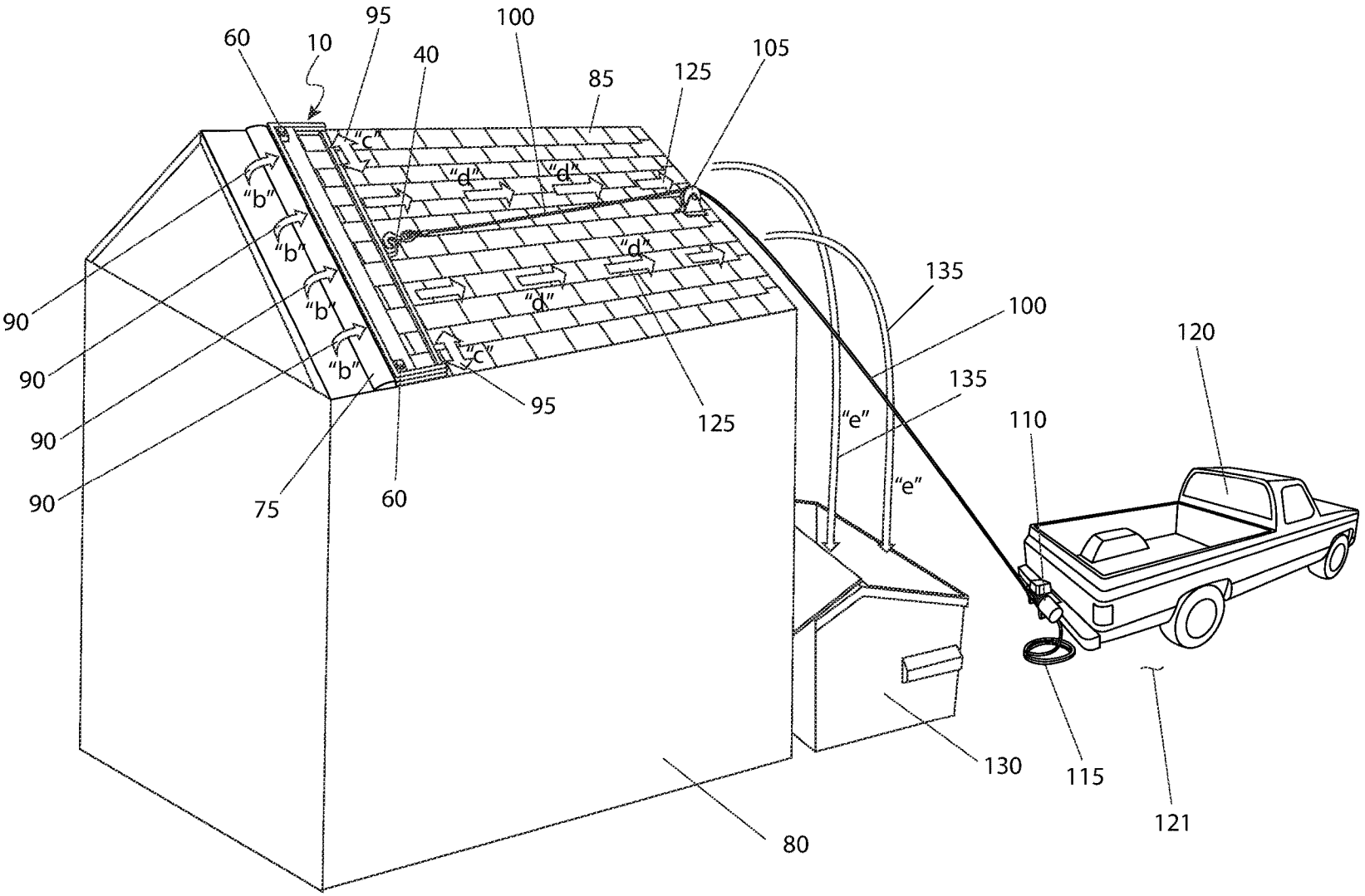

Referring to FIG. 9, a perspective view of the roofing material removal apparatus 10, shown in a utilized state, according to the preferred embodiment of the present invention is depicted. A structure 80 such as a house is provided with a roofed surface 85 that is to be removed for various reasons, including but not limited to: replacement, remodeling, demolition or the like. The roofing material removal apparatus 10 is placed at a first edge of the roofed surface 85. The roofing material 75 is lifted manually along this edge and secured in the roofing material removal apparatus 10 as shown in FIG. 4 along an insertion travel path "b" 90. The sleeves 30 and first fasteners 35 (both of which are shown in FIG. 1) are manipulated as desired to extend the roofing material removal apparatus 10 along an adjustable length travel path "c" 95, such that all or some of the roofed surface 85 may be removed in single pass of the roofing material removal apparatus 10. As aforementioned described, multiple passes with the roofing material removal apparatus 10 may be necessary on a larger roofed surface 85.

A flexible high strength cable 100, such as aircraft cable, is affixed to the pulling eye 40 and routed through a pulley 105 and onto a capstan winch 110. The pulley 105 is secured to the far edge of the roofed surface 85 to prevent the high strength cable 100 from damaging the structure 80. The capstan winch 110 does not store high strength cable 100 on the drum but allows a cable leading edge 115 to apply pulling pressure before being passed and stored. The capstan winch 110 is secured to an immovable object 120, here shown as a vehicle for purposes of illustration. During operation, the capstan winch 110 produces pulling power that is applied to the roofing material removal apparatus 10 thus moving it along the roofed surface 85 along an apparatus travel path "d" 125. In the process of doing so, the roofed surface 85 is removed and is pushed by the roofing material removal apparatus 10 to the far edge of the structure 80 where it preferably collects into a container 130 along a falling material travel path "e" 135. The second fasteners 60 (shown in FIG. 2 and FIG. 4) are then removed, the lower frame 15 and the upper frame 20 (both of which are as shown in FIG. 1) are opened, and the roofing material 75 (as shown in FIG. 4) is removed. The above process is repeated for any other areas of the roofed surface 85 to be removed from the structure 80.

3. OPERATION OF THE PREFERRED EMBODIMENT

The preferred embodiment of the present invention can be utilized by the common user in a simple and effortless manner with little or no training. It is envisioned that the roofing material removal apparatus 10 would be constructed in general accordance with FIG. 1 through FIG. 9. The user would procure the roofing material removal apparatus 10 from conventional procurement channels such as home improvement stores, lumber and roofing supply houses, hardware stores, mail order and internet supply houses and the like.

After procurement and prior to utilization, the roofing material removal apparatus 10 would be positioned upon a roofed surface 85, as shown in FIG. 9. The lower frame 15 would be separated from the upper frame 20 along the pivot points 25 to produce an open insertion space 70 as shown in FIG. 1 and FIG. 3. The overall length of the roofing material removal apparatus 10 would be adjusted as needed by loosening all first fasteners 35, manipulating any structural elements (i.e., the lower front portion 42, the lower rear portion 44, and the upper rear portion 46) within the sleeves 30, and retightening the first fasteners 35. A first edge of the roofing material 75 would be loosened manually from the roofed surface 85 (along a drip edge for example), folded back, and inserted into the open insertion space 70 thus produced. The gripping teeth 55*a*, 55*b* may penetrate a portion of the roofing material 75. The lower frame 15 and the upper frame 20 would then be closed together and secured via second fasteners 60 that are inserted into the coaligned tabs 50*a*, 50*b* and tightened to a specified torque. The cable 100 would be secured to the pulling eye 40, routed through the pulley 105, and placed about the capstan winch 110. At this point in time, the roofing material removal apparatus 10 is ready for use.

During utilization of the roofing material removal apparatus 10, the user would stand safely on ground surface 121, preferable near the operating controls of the capstan winch 110. With the capstan winch 110 energized, the roofing material removal apparatus 10 is pulled along the adjustable length travel path "c" 95, thus removing, loosening, and pulling the roofing material 75 from the structure 80. This action continues for the entirety of the roofed surface 85 as roofing material 75 falls onto the ground surface 121 or into a container 130 via a falling material travel path "e" 135. The capstan winch 110 allows for the cable 100 of unlimited length to be used, as excess unused cable (cable leading edge 115) is removed and stored as needed. Once the apparatus travel path "d" 125 has been completed, the second fasteners 60 are removed, the lower frame 15 and the upper frame 20 separated along the pivot points 25, and freed from the roofing material 75.

After use of the roofing material removal apparatus 10, the above process may be repeated as needed to remove all roofing material 75 from the structure 80. Upon completion of a site project, the roofing material removal apparatus 10 and related components such as the cable 100, pulley 105, capstan winch 110, and the like are stored until needed again in a repeating cyclic manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A roofing material removal apparatus comprising:
a lower frame;
an upper frame; and,
a set of sleeves on the lower front portion, lower rear portion, and upper rear portion of the frames, said sleeves providing width adjustment along an adjustable width travel path; and,
wherein the lower frame and the upper frame are joined together at a pair of pivot points;
wherein the upper frame is pivotable between an open insertion space and a closed position; and,
wherein the apparatus includes a pulling eye positioned at a central point of the lower frame and,
wherein said lower frame and said upper frame are constructed of individual structural elements, selected from the group consisting of steel tubing and steel angle;
wherein the lower frame comprises a rectangular steel frame having a lower front portion, a pair of lower side portions, and a lower rear portion, while the upper frame comprises a three-sided steel frame having a pair of upper side portions and an upper rear portion; and,
wherein a pair of lugs extend upward from opposing front corners of the lower frame, said lugs providing a pivoting attachment for a distal front ends of the pair of upper side portions to the lugs.

2. The apparatus of claim 1, wherein said sleeves are secured with at least one first fastener.

3. The apparatus of claim 2, further comprising multiple threaded lower tabs spaced along the lower rear portion of the lower frame, and multiple threaded upper tabs spaced along an upper rear portion of the upper frame, said tabs coaligning when the upper frame is in the closed position.

4. The apparatus of claim 1, further comprising lower gripping teeth extending outward from an upper surface of the lower rear portion, a set of sleeves, and the lower side portions of the lower frame.

5. The apparatus of claim 4, further comprising upper gripping teeth extending outward from an upper surface of the upper rear portion and an upper side portions of the upper frame.

6. The apparatus of claim 1, wherein the upper frame pivots about the pivot points to produce the open insertion space.

7. The apparatus of claim 1, further comprising a plurality of second fasteners configured to hold aligned pairs of tabs in physical contact when the apparatus is in the closed position.

8. The apparatus of claim 1, wherein the pulling eye is used in conjunction with a flexible high strength cable, a pulley, and a capstan winch to move the apparatus along a roofed surface.

9. The apparatus of claim 8, wherein the high strength cable is routed through the pulley and onto the capstan winch, and the capstan winch is secured to an immovable object.

10. The apparatus of claim 1, wherein the apparatus is adjustable in length by manipulating the set of sleeves and first fasteners to extend the apparatus along an adjustable length travel path.

11. The apparatus of claim 1, wherein the lower frame and the upper frame form a minimal gap between each other when in the closed position.

12. The apparatus of claim 1, wherein the upper frame is approximately eight inches (8 in.) wide and six feet (6 ft.) long.

13. The apparatus of claim 1, wherein the lower frame comprises a lower front portion having a pulling eye located at the front portion and extending forwardly therefrom.

14. The apparatus of claim 1, wherein the apparatus is used to remove roofing material, such as existing roof shingles and tar paper, from a roofing surface of a structure and onto a ground surface or a container.

15. The apparatus of claim 1, wherein the apparatus is for use on sections of a roofing surface that are smaller and larger than a overall length by adjusting a length of the apparatus using a set of sleeves and first fasteners.

16. The apparatus of claim 1, wherein multiple passes of the apparatus are used to remove roofing material from extremely larger roofed surface areas.

* * * * *